US007893845B2

(12) United States Patent
Ritzau

(10) Patent No.: US 7,893,845 B2
(45) Date of Patent: Feb. 22, 2011

(54) SOCKET AND PLUG CONNECTOR FOR ELECTRONIC DEVICE

(75) Inventor: Tobias Ritzau, Veberod (SE)

(73) Assignee: Sony Ericsson Mobile Communications AB, Lund (SE)

( * ) Notice: Subject to any disclaimer, the term of this patent is extended or adjusted under 35 U.S.C. 154(b) by 299 days.

(21) Appl. No.: 12/109,968

(22) Filed: Apr. 25, 2008

(65) Prior Publication Data

US 2009/0267785 A1 Oct. 29, 2009

(51) Int. Cl.
*G08B 21/00* (2006.01)

(52) U.S. Cl. ..... 340/686.2; 439/490

(58) Field of Classification Search ..... 340/686.2; 439/39, 374, 488–490
See application file for complete search history.

(56) References Cited

U.S. PATENT DOCUMENTS 7,589,536 B2 * 9/2009 Terlizzi et al. ..... 324/538
2004/0209489 A1 10/2004 Clapper
2004/0219824 A1 11/2004 Conn
2007/0072442 A1 3/2007 DiFonzo et al.

FOREIGN PATENT DOCUMENTS

EP 1 686 025 A2 8/2006
WO 2006/106553 A1 10/2006

OTHER PUBLICATIONS

International Search Report corresponding to PCT/EP2008/064120, mailed Mar. 4, 2009.
Written Opinion corresponding to PCT/EP2008/064120, mailed Mar. 4, 2009.

* cited by examiner

*Primary Examiner*—John A Tweel, Jr.
(74) *Attorney, Agent, or Firm*—Renner, Otto, Boisselle & Sklar, LLP

(57) ABSTRACT

The present invention relates to a socket for connecting a plug to an electronic device, comprising a sensor device, wherein the socket is adapted to be arranged in an electronic device and to be connected to a plug, the sensor device is adapted to detect a plug when it is arranged at the socket and adapted to emit a signal when it detects a plug. The present invention further relates to a plug for connecting a socket to an electronic device and to a system comprising a plug and a socket.

15 Claims, 3 Drawing Sheets

SOCKET AND PLUG CONNECTOR FOR ELECTRONIC DEVICE

TECHNICAL FIELD

The present invention relates to a socket for connecting a plug to an electronic device and to a plug for connecting a socket to an electronic device.

BACKGROUND ART

To connect a socket to a plug in an intended and correct way, it is known to design the socket and the plug to only allow the plug to be arranged in the socket in one way. A user that should arrange the plug in the socket thus has to see both the socket and the plug to be able to connect them.

A problem of this connection is for instance if a plug of a charger should be connected to a socket of a mobile phone and the lighting is poor. The user then has a problem of locating the socket and to orient the plug in a correct manner in relation to the socket.

Another problem is when a plug of an electronic device should be connected to the back side of a computer. The back side of a computer is often difficult to reach and even more difficult for the user to see.

SUMMARY OF THE INVENTION

A socket as defined in claim 1, a plug as defined in claim 9 and a system as defined in claim 17 is provided according to the present invention.

The present invention relates to a socket for connecting a plug to an electronic device, comprising a sensor device, wherein the socket is adapted to be arranged in an electronic device and to be connected to a plug, the sensor device is adapted to detect a plug when it is arranged at the socket and adapted to emit a signal when it detects a plug.

An advantage of a socket according to this is that the signal helps a user that should connect the socket to a plug to find the plug.

A further advantage is that the signal could be used to guide a user to find the correct socket, for instance on the back side of a computer.

The sensor device can be adapted to detect the orientation of the plug.

The sensor device can be adapted to detect the compatibility of the plug in relation to the socket.

The sensor device can be adapted to emit a first signal if the sensor device detects that the plug is oriented correct in relation to a socket and a second signal if the sensor device detects that the plug is oriented incorrect in relation to the socket.

To achieve the advantages of that the user visually is able to see when a plug is arranged at the socket and to see the plug, the sensor device can comprise a lamp, which is adapted to emit light as the signal.

The sensor device can comprise a magnet, which is adapted to interact with a magnet on the plug.

The sensor device can comprise a speaker, which speaker is adapted to emit a sound as the signal.

The present invention further relates to a plug for connecting a socket to an electronic device, comprising a sensor device, wherein the plug is adapted to be arranged in an electronic device and to be connected to a socket, the sensor device is adapted to detect a socket when it is arranged at the plug and adapted to emit a signal when it detects a socket.

The sensor device can be adapted to detect the orientation of the socket.

The sensor device can be adapted to detect the compatibility of the socket in relation to the plug.

The sensor can be adapted to emit a first signal if the sensor device detects that the plug is oriented correct in relation to a socket and a second signal if the sensor device detects that the plug is oriented incorrect in relation to the socket.

The sensor device can comprise a lamp, which is adapted to emit light as a signal.

The sensor device can comprise a magnet, which is adapted to interact with a magnet on the socket.

The sensor device can comprise a speaker, which speaker is adapted to emit a sound as the signal.

The sensor device of the socket and/or the plug can comprise a near field communicator.

The present invention further relates to a system comprising a first electronic device and a second electronic device, wherein one of the first and the second electronic device comprise a socket and the other of the first and the second electronic device comprise a plug, the plug is adapted to be connected to the socket, the socket comprise a sensor, which sensor is adapted to detect the plug when the plug is arranged at the socket.

The socket of the system can be a socket according to the socket disclosed above.

The plug of the system can be a plug according to the plug disclosed above.

BRIEF DESCRIPTION OF THE DRAWINGS

The features and advantages of the present invention will be more apparent from the following description of preferred embodiments with reference to the accompanying drawings, in which FIG. 1 schematically illustrates a mobile phone and a charger.

DETAILED DESCRIPTION

Embodiments of the present invention relate, in general, to a socket and to a plug of an electronic device, such as a mobile phone. However, for the sake of clarity and simplicity, most embodiments outlined in this specification are related to mobile phones.

In the following description reference is made to the accompanying drawings. In this regard directional terminology, such as "top", "bottom", "front", "back" etc, is used with reference to the orientation of the figures being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present protection. The following detailed description is not to be taken in a limiting sense, and the scope of the present invention is defined by the appended claims.

Furthermore, it should be emphasised that the term comprising or comprises, when used in this description and in the appended claims to indicate included features, elements or steps, is in no way to be interpreted as excluding the presence of other features elements or steps than those expressly stated.

Figure 1:
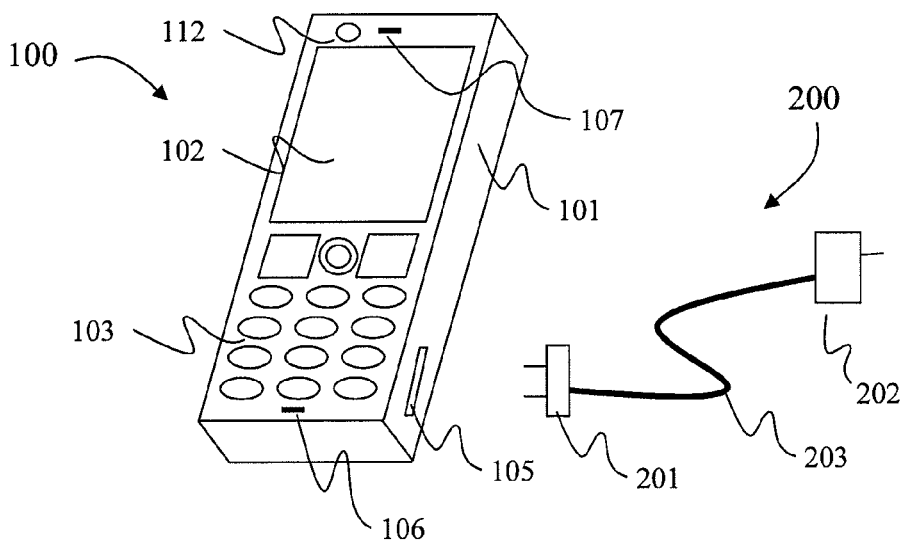

FIG. 1 disclose a typical mobile communication device 100, comprising a casing 101, a display area 102, a input means 103 in the form of a keypad, a socket 105, a microphone 106 and a speaker 107, and a charger 200 comprising a plug 201, a socket 202 and a cable 203. The mobile communication apparatus 100 can also comprise other elements normally present in such a device, such as a camera 112, a processor (not shown), a memory (not shown), an accelerometer (not shown), a vibration device (not shown), etc.

Figure 2:
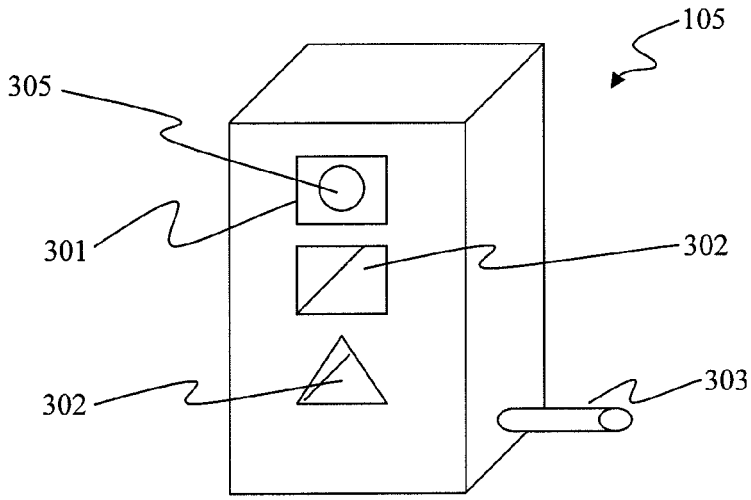
FIG. 2 schematically illustrates a socket according to an embodiment of the invention.

FIG. 2 disclose a socket 105 comprising a sensor device 301, connecting recesses 302 and a coupling means 303.

The connecting recesses 302 are adapted to receive connecting projections of the plug 201 to connect the socket 105 to the plug 201. The connecting recesses 302 are arranged at one side of the socket 105 such that, when the socket is arranged in an electronic device, the openings of the connecting recesses 302 are directed away from the electronic device.

The coupling means 303 is adapted to connect the socket to an electronic device such as a mobile phone or a computer. When the plug 201 is arranged to the socket 105, an electronic device connected to the socket could communicate and/or interact with an electronic device connected to the plug. The connection between two electronic devices via a plug and a socket as such is disclosed in the prior art and will thus not be further explained hereafter.

The sensor device 301 comprises a lamp 305. The lamp 305 could for instance be a LED or any other light emitting means. The lamp 305 is arranged on the same side of the socket 105 as the connection recesses 302. The lamp 305 is adapted to emit light in a direction directed away from the electronic device. The sensor device 301 is adapted to detect when a plug is at the socket 105. The sensor device 301 is adapted to turn on the lamp 305 as a signal when it has detected a plug at the socket 205.

When a user should connect two electronic devices by connecting a plug to the socket 105, the user moves the plug (or the socket 105) towards the socket 105. As the plug is moved such that it is located in the vicinity at the socket 105, the sensor device 301 of the socket 105 will detect the presence of the plug.

As the sensor device 301 has detected the plug it will emit a signal by turning on the lamp 305. As the lamp 305 emits light the user is able to see the plug and the socket 105 even if it otherwise is dark. As the user is able to see the plug and the socket the user is able to orient the plug correct in relation to the socket and to connect the socket and the plug.

A further advantage is if the electronic device comprise several sockets and the user does not know in which socket the plug should be arranged in. When the user moves the plug in the vicinity of the correct socket, the sensor device 301 will detect it and emit light as a signal. As the user sees from which socket the light is emitted the user will be guided to connect the plug to the correct socket.

Figure 3:
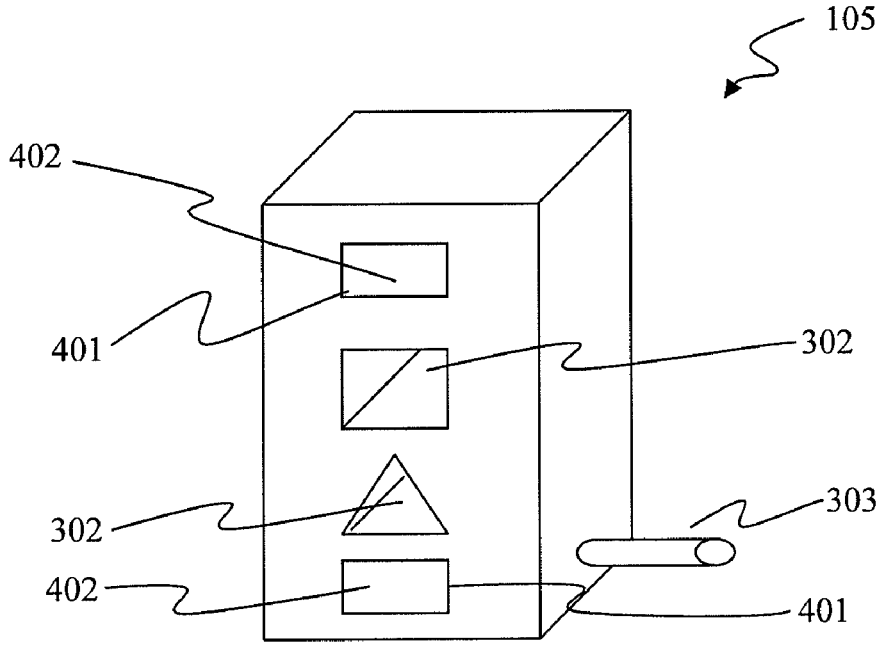
FIG. 3 schematically illustrates a socket according to an embodiment of the invention.

FIG. 3, to which reference now is made, disclose a socket 105 according to an embodiment comprising two sensor devices 401, connecting recesses 302 and a coupling means 303.

The sensor device 401 comprises a magnet 402. The magnets 402 are adapted to interact with a plug. They could for instance be adapted to interact with magnetic metals of the plug or with magnets on the plug.

When a user should connect two electronic devices by connecting a plug to the socket 105, the user moves the plug (or the socket 105) towards the socket 105. As the plug is moved such that it is located in the vicinity at the socket 105, the magnets 402 of the sensor device 401 will detect the presence of the plug. The user will feel the magnetic forces as a signal from the sensor device 401 when it detects the plug.

If the plug is oriented correct in relation to the socket the magnetic attraction between the magnets and the plug will signal to the user that the plug is ready to be connected to the socket. If however the plug is oriented incorrect in relation to the socket the magnets 402 will repel the plug. The user will feel the signal and reorient the plug until the user feels the magnetic attraction between the magnets and the plug.

The sensor device 401 could further comprise a lamp, as disclosed in connection with the embodiment above, to even further facilitate the connection of the socket and the plug.

Figure 4:
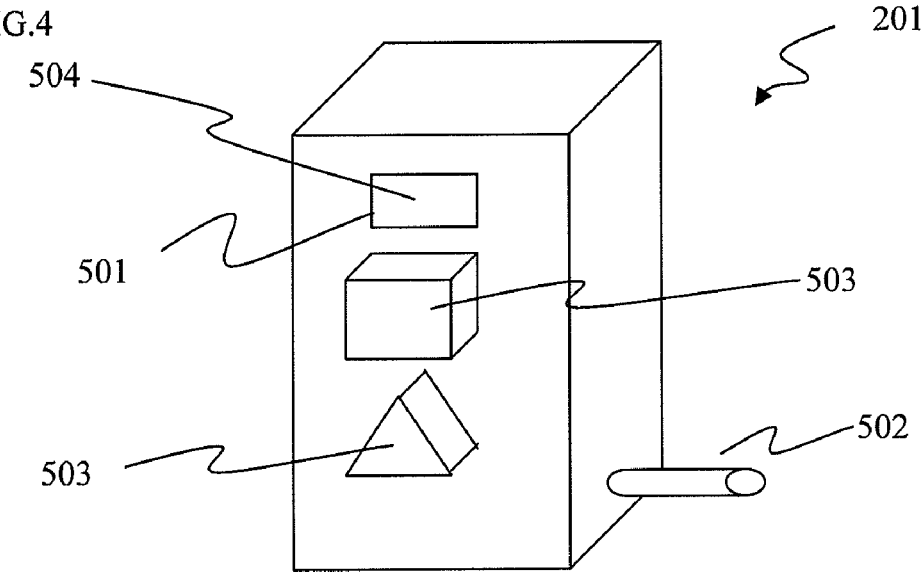
FIG. 4 schematically illustrates a plug according to an embodiment of the invention.

FIG. 4 disclose a plug 201 according to an embodiment of the invention comprising a sensor device 501, a coupling device 502 and connecting projections 503.

The coupling device 502 is adapted to connect the plug to an electronic device such as a mobile phone, a charger, earphones or a computer. When the plug 201 is connected to a socket, an electronic device connected to the socket could communicate and/or interact with an electronic device connected to the plug. The connection between two electronic devices via a plug and a socket as such is disclosed in the prior art and will thus not be further explained hereafter.

The connecting projections 503 are adapted to be arranged in the connecting recesses of a socket. The connecting projections 503 are arranged on a side of the plug 201 that is directed away from an electronic device when the plug is connected to said electronic device. The design of the connecting projections 503 as such, and the connection recesses as such disclosed above, are known in the prior art and will thus not be explained further herein.

The sensor device 501 is arranged on the same side of the plug as the connecting projections 503. The sensor device 501 comprises a loudspeaker 504. The sensor device 501 is adapted to emit a signal by instructing the loudspeaker 504 to emit a sound.

When a user should connect two electronic devices by connecting the plug 201 to a socket, the user moves the plug 201 (or the socket) towards the socket (or the plug). As the plug 201 is moved such that it is located in the vicinity at the socket, the sensor device 501 will detect the presence of the socket. The sensor device 501 thereafter instructs the loudspeaker 504 to emit a sound. The emitted sound could be a first sound if the plug is oriented correct in relation to the socket and a second sound if the plug is oriented incorrect in relation to the socket to guide the user.

Figure 5A:
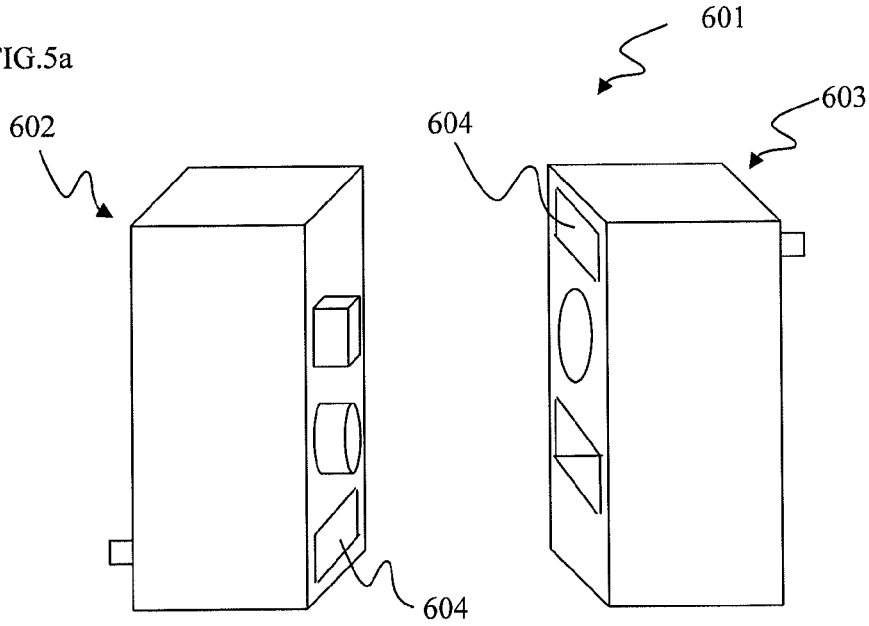
FIG. 5*a* schematically illustrates a plug and a socket according to an embodiment of the invention.
Figure 5B:
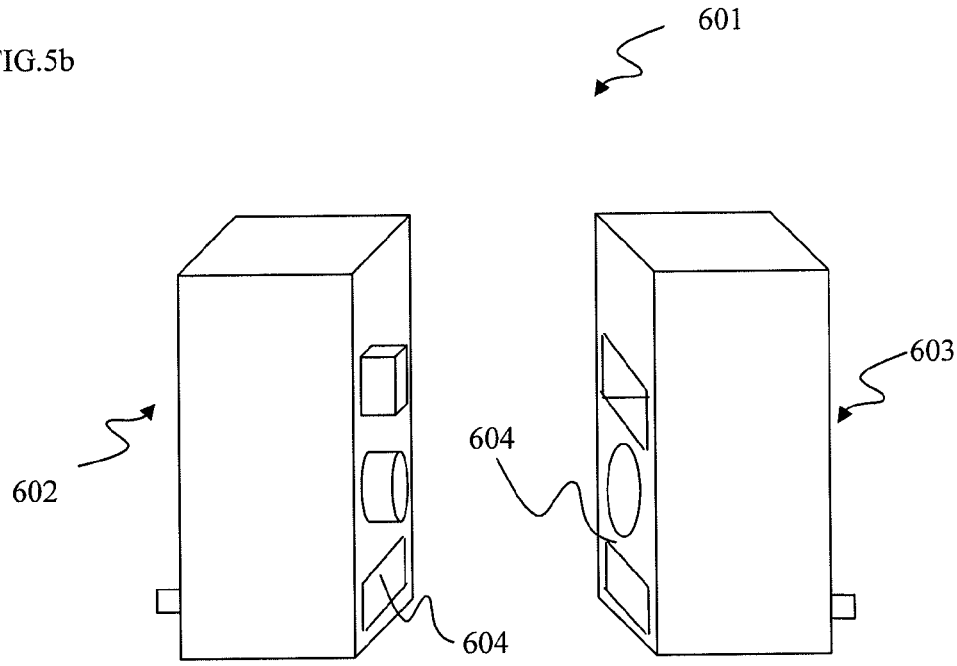
FIG. 5*b* schematically illustrates a plug and a socket according to an embodiment of the invention.

FIGS. 5*a* and 5*b* disclose a system 601 of a plug 602 and a socket 603 according to the invention. The plug and the socket could be a plug and a socket as disclosed above. If the plug 602 and the socket 603 is arranged incorrect in relation to each other, see FIG. 5*a*, the sensor device 604 will detect it and signal a first signal. The first signal could for instance be light, a sound, and/or magnetic forces.

The user then gets the input of that the plug is oriented incorrect in relation to the socket, see FIG. 5*b*. After receiving the input the user to reorient the plug in relation to the socket until the user receives a second signal. The second signal could for instance be light, a sound, and magnetic forces. When the user receives the second signal the user knows that the plug is oriented correct in relation to the socket and can insert the connecting projections of the plug into the connecting recesses of the socket.

The sensor devices described above in connection to either a socket or a plug could also be arranged of the other of the socket and the plug.

The sensor device could be used to identify the manufacturer of the plug and the socket to for instance identify pirate copies.

The sensor device comprises a near field communicator to identify if a socket/plug is present at a plug/socket.

The principles of the present invention have been described in the abovementioned by examples of embodiments or modes of operations. However, the invention should not be construed as being limited to the particular embodiments discussed above, which are illustrative rather than restrictive, and it should be appreciated that variations may be made in those embodiments by persons skilled in the art, without departing from the scope of the present invention as defined by the appended claims.

The invention claimed is:

1. Socket for connecting a plug to an electronic device, wherein the socket is adapted to be arranged in an electronic device and to be connected to a plug;

the socket comprises a sensor device adapted to detect the presence of a plug arranged in vicinity of the socket and wherein the sensor device further comprises a lamp adapted to emit a light, and the sensor device is adapted to turn on the lamp as a signal when it has detected the plug in the vicinity of the socket, thereby enabling the user to see the plug and the socket even if it otherwise is dark.

2. Socket according to claim 1, wherein the sensor device is adapted to detect the orientation of the plug.

3. Socket according to claim 1, wherein the sensor device further is adapted to detect the compatibility of the plug in relation to the socket.

4. Socket according to claim 2, wherein the sensor is adapted to emit a first signal if the sensor device detects that the plug is oriented correct in relation to a socket and a second signal if the sensor device detects that the plug is oriented incorrect in relation to the socket.

5. Socket according to claim 1, wherein the sensor device comprises a magnet, which is adapted to interact with a magnet or a magnetic material on the plug.

6. Socket according to claim 1, wherein the sensor device comprises a speaker, which speaker is adapted to emit a sound.

7. Plug for connecting a socket to an electronic device, wherein the plug is adapted to be arranged in an electronic device and to be connected to a socket, the plug comprises a sensor device adapted to detect a socket when it is arranged in the vicinity of the plug and wherein the sensor device comprises a lamp adapted to emit a light and the sensor device is adapted to turn on the lamp as a signal when it has detected the plug in the vicinity of the socket, thereby enabling the user to see the plug and the socket even if it otherwise is dark.

8. Plug according to claim 7, wherein the sensor device is adapted to detect the orientation of the socket.

9. Plug according to claim 7, wherein the sensor device further is adapted to detect the compatibility of the socket in relation to the plug.

10. Plug according to claim 8, wherein the sensor device is adapted to emit a first signal if the sensor device detects that the plug is oriented correct in relation to a socket and a second signal if the sensor device detects that the plug is oriented incorrect in relation to the socket.

11. Plug according to claim 7, wherein the sensor device comprises a magnet, which is adapted to interact with a magnet or a magnetic material on the socket.

12. Plug according to claim 7, wherein the sensor device comprises a speaker, which speaker is adapted to emit a sound.

13. System comprising a first electronic device and a second electronic device, wherein one of the first and the second electronic device comprises a socket and the other of the first and the second electronic device comprise a plug;

the plug is adapted to be connected to the socket;

the socket comprises a sensor device adapted to detect the plug when the plug is arranged in vicinity of the socket and wherein the sensor device further comprises a lamp adapted to emit light, and the sensor device is adapted to turn on the lamp as a signal when it has detected the plug in the vicinity of the socket, thereby enabling the user to see the plug and the socket even if it otherwise is dark.

14. System according to claim 13, wherein the socket comprises a socket for connecting a plug to an electronic device, comprising a sensor device, wherein the socket is adapted to be arranged in an electronic device and to be connected to a plug, the sensordevice is adapted to detect a plug when it is arranged at the socket and adapted to emit a signal when it detects a plug.

15. System according to claim 13, wherein the plug comprises a sensor device, wherein the plug is adapted to be arranged in an electronic device and to be connected to a socket, the sensor device is adapted to detect a socket when it is arranged at the plug and adapted to emit a signal when it detects a socket.

* * * * *

UNITED STATES PATENT AND TRADEMARK OFFICE

CERTIFICATE OF CORRECTION

PATENT NO. : 7,893,845 B2
APPLICATION NO. : 12/109968
DATED : February 22, 2011
INVENTOR(S) : Tobias Ritzau It is certified that error appears in the above-identified patent and that said Letters Patent is hereby corrected as shown below:

Claim 14, col. 6, line 40, sensordevice should be sensor device

Signed and Sealed this
Nineteenth Day of April, 2011

David J. Kappos

David J. Kappos
*Director of the United States Patent and Trademark Office*